United States Patent [19]

Hatfield

[11] 4,388,353

[45] Jun. 14, 1983

[54] METHOD AND APPARATUS FOR APPLYING ENAMELS

[75] Inventor: Raymond W. Hatfield, Warren, Mich.

[73] Assignee: Michael Ladney, Jr., Grosse Pointe Shores, Mich.

[21] Appl. No.: 285,314

[22] Filed: Jul. 22, 1981

[51] Int. Cl.[3] ..... B05D 1/02

[52] U.S. Cl. ..... 427/422; 239/8; 239/13; 239/134; 427/421

[58] Field of Search ..... 427/422, 421; 239/8, 239/13, 134

[56] References Cited

U.S. PATENT DOCUMENTS 2,855,330 10/1958 Griswold et al. ..... 427/422 X 3,657,001 4/1972 Parker ..... 427/422 X 4,132,357 1/1979 Blackinton ..... 239/290 X

FOREIGN PATENT DOCUMENTS 133962 8/1949 Australia ..... 427/422

*Primary Examiner*—Shrive P. Beck

*Attorney, Agent, or Firm*—Barnes, Kisselle, Raisch, Choate, Whittemore & Hulbert

[57] ABSTRACT

An enamel having a thermosensitive catalyst therein is applied to a workpiece by means of a spray gun supplied with a large volume of heated air at a low pressure. The heated air initiates activation of the catalyst substantially immediately upon discharge from the spray gun and, thus, produces a painted surface which is dust-free within a minimum time period.

7 Claims, No Drawings

METHOD AND APPARATUS FOR APPLYING ENAMELS

This invention relates to spray painting enamels and, more particularly, to painting of workpieces with thermosetting enamels by means of a spray gun.

Thermosetting enamels, such as arcylic enamels, dry by reason of a progressive cross linking reaction, the speed of which is determined primarily by the temperature at which the reaction occurs. In order to obtain fast drying, enamel sprayed parts are usually baked promptly after application at an elevated temperature (say, 250° to 350° F.) for a predetermined period of time. However, depending upon the ambient conditions and the cleanliness of the surrounding atmosphere, painted enameled parts frequently have surface blemishes and imperfections because of dust and other contaminants which may adhere to the painted surface before it becomes sufficiently dry; that is, between the time they are sprayed and the time they are introduced into the baking oven. The quicker a thermosetting enamel is caused to cure to a dust-free condition the less is the tendency for dust and other contaminants to adhere to the painted surface and the production of a smooth, blemish-free surface is better assured.

The present invention has for its object a method of spraying a thermosetting enamel by means of an air gun in a manner so as to produce a blemish-free, smooth surface.

More specifically, the invention is directed to a method of spraying a thermosetting enamel wherein a thermal sensitive catalyst is incorporated in the enamel and the spray gun is supplied with a high volume of heated air at low pressure. The combination of the catalyst with the high volume of low pressure air at an elevated temperature produces a dust-free surface within a minimum period of time.

In accordance with the invention air is supplied to a spray gun in a heated condition. The air is heated in any suitable manner and, since it is desired to utilize a large volume of air at a low pressure, an impellor type blower, one employing a plurality of turbine blades, is admirably suited for this purpose. By using air at a relatively low pressure (say 1 to 7 pounds per square inch), a minimum of turbulence results at the spray nozzle and at the surface of the part being painted. Lack of turbulence not only results in less dust, but also enables the spray to penetrate smoothly and relatively uniformly into small grooves and crevices in the part being painted. This is particularly important in connection with painting masked workpieces because the enamel or other paint can be applied so that it penetrates directly to the edge of the mask and thereby provides a sharp line of demarcation between the painted and masked surfaces. Likewise, in view of the lack of turbulence, the paint does not tend to creep or bounce under the edges of the mask and an extremely close fit between the mask and the part being painted is not required, as is the case with conventional spray painting at a pressure of say 60 pounds per square inch. When a workpiece is to be selectively chromium plated, for example, and, therefore, mask sprayed with a coat of resist paint, a sharp line of demarcation is extremely important from the standpoint of preventing the build-up of chromium along the line between plated and painted sections of the workpiece.

The air blower utilized in accordance with the invention is of any conventional type, either single or multiple stage, adapted to deliver a large volume of air, say 90 to 200 cubic feet per minute, and to heat the air to an elevated temperature in the range of about 50° to 150° F. above ambient. The temperature at the nozzle of the spray gun will vary depending upon the temperature of the air generated at the blower, the ambient temperature, the length of the air line or hose between the blower and the spray gun and the extent to which the air line or hose is insulated. In accordance with the present invention, the temperature of the air discharging from the nozzle of the gun should be in the range of at least 100° F. to as high as 220° F.

The use of a large volume of heated air has many distinct advantages. Aside from the fact that it promotes solvent evaporation and permits spraying at higher paint resin solids content, it initiates activation of the catalyst in the enamel substantially immediately and, thus, produces a dust-free painted surface within one to three minutes as compared with five to ten minutes or more with conventional spraying techniques at the pressure of say 60 pounds per square inch. The expression "dust free" designates a degree of cure such that dust will no longer adhere to the painted surface. The production of a dust free surface in a minimum time period is extremely important in most any painting operation since at least some dust is inevitably present in the surrounding atmosphere. Since the heated air initiates activation of the catalyst substantially immediately as the paint leaves the spray nozzle and also accelerates substantially evaporation of the solvent as compared with conventional high pressure paint spraying, a smooth and blemish-free surface is readily obtained.

The invention is applicable in connection with any conventional enamel, such as a thermosetting acrylic enamel. The catalyst employed is any suitable organic acid catalyst. A catalyst that has produced excellent results is a 75% solution of phenyl acid phosphate in butyl alcohol sold commercially as Mobil Chemical PA-75. The catalyst is added to the enamel in the range of about 1 to 5%.

In the preferred method of spraying the catalyzed enamel, the spray gun and blower are controlled so that the temperature of the air at the gun is about 110° to 140° F., the pressure is about 2 to 4 pounds per square inch, and the volume of air is between 120 and 160 cubic feet per minute. However, these ranges of temperature, pressure and volume of air will obviously vary in accordance with the particular part being painted and the surrounding conditions and objectives of the specific operation. In any event, the heated air will initiate the catalytic reaction substantially immediately and then the reaction will proceed at a rate depending upon the ambient temperature to produce a painted surface which is dust free long before the part enters the baking oven.

Under ordinary conditions where the ambient temperature is about 60° to 70° F. a dust free surface will be obtained in a matter of 1 to 3 minutes when the enamel is applied in accordance with the invention. In a production paint spraying facility in accordance with this invention, the painted parts become dust free by the time they are conveyed to a baking oven. The enameled parts can be baked at a temperature as low as about 140° F. This is also important since many plastic workpieces cannot be subjected to baking temperature substantially higher than 140° F., such as 250° to 350° F. at which enameled parts are normally baked.

I claim:

1. The method of applying an acrylic enamel to a workpiece so that the painted surface becomes dust free at an ambient temperature of between about 60° to 70° F. within one to three minutes after spraying which comprises, adding a thermosensitive organic acid catalyst to the enamel for accelerating the curing time of the enamel and directing the enamel through the nozzle of a spray gun supplied with atomizing air at a pressure of 1 to 7 pounds per square inch and at a rate of about 90 and 250 cubic feet per minute, said atomizing air being heated such that its temperature as it issues from the nozzle is between about 110° to 140° F., whereby the heat of the air initiates activation of the catalyst substantially immediately upon discharge of the enamel from the nozzle.

2. The method called for in claim 1 including the step of baking the painted part at a temperature of at least 140° F. after the surface thereof has become dust free.

3. The method called for in claim 1 wherein the heated air is supplied to the nozzle at the rate of between 120 and 160 cubic feet per minute.

4. The method called for in claim 3 wherein air is supplied to the nozzle of the gun at a pressure of between 2 and 4 pounds per square inch.

5. The method called for in claim 1 wherein the catalyst is a solution of phenyl acid phosphate in butyl alcohol.

6. The method called for in claim 5 wherein the catalyst is added to the enamel in an amount of between 1% and 5% by weight.

7. The method called for in claim 1 wherein the air is directed from the blower to the spray gun through a heat insulated conduit.

* * * * *